US005956799A

United States Patent [19]

Panaccione et al.

[11] Patent Number: 5,956,799

[45] Date of Patent: Sep. 28, 1999

[54] PUTTY KNIFE AND SCRAPER HANDLE

[76] Inventors: Mark Thomas Panaccione, 12932 SW. Bradley La., Tigard, Oreg. 97224; Donald Paul Cummings, 19 Old Village Rd., Sturbridge, Mass. 01566

[21] Appl. No.: 08/926,758

[22] Filed: Sep. 10, 1997

[51] Int. Cl.[6] ..... A47L 13/022

[52] U.S. Cl. ..... 15/236.01; 15/143.1; 16/111 R; 81/177.1

[58] Field of Search ..... 15/143.1, 235.4, 15/236.01; 16/110 R, 111 R; 30/169, 340; 81/77.1, 492, 900

[56] References Cited

U.S. PATENT DOCUMENTS

| | | | |
|---|---|---|---|
| 264,527 | 9/1882 | Haley | 81/177.1 |
| 1,512,920 | 10/1924 | Galvin | 81/177.1 |
| 1,694,559 | 12/1928 | Osgood | 81/492 |
| 4,524,514 | 6/1985 | Mallalieu et al. | 30/169 |
| 4,639,029 | 1/1987 | Kolonia . | |
| 4,721,021 | 1/1988 | Kusznir . | |
| 4,739,536 | 4/1988 | Bandera et al. . | |
| 4,969,231 | 11/1990 | Mader et al. . | |
| 5,208,984 | 5/1993 | Negus | 15/236.01 |
| 5,327,612 | 7/1994 | Kelsay . | |
| 5,390,572 | 2/1995 | Gakhar et al. . | |
| 5,446,941 | 9/1995 | Kelsay . | |
| 5,530,989 | 7/1996 | Remmert et al. . | |
| 5,615,445 | 4/1997 | Kelsay et al. | 15/235.4 |
| 5,722,116 | 3/1998 | Lin | 81/177.1 |

OTHER PUBLICATIONS

Advertisement from Feb. 1997 *Industrial Products Bulletin*, p. 61.

*Primary Examiner*—Terrence R. Till
*Attorney, Agent, or Firm*—Ronald R. Kilponen

[57] ABSTRACT

An ergonomic putty knife and scraper handle manufactured from at least two different hardness injection molded polymers having a plurality of harder longitudinal ribs embedded in a softer overlay but exposed on both top and bottom surfaces in strategic locations. The longitudinal ribs providing non-binding contact with fabric surfaces to ease the insertion and removal of the handle into and from a user's pocket for temporary storage of the tool when not in use. When employing the tool for its intended purpose, however, the user enjoys the comfort, efficiency and safety of an ergonomic handle offering a "soft touch" to thumb and fingers in those locations requiring superior grippability.

20 Claims, 14 Drawing Sheets

PUTTY KNIFE AND SCRAPER HANDLE

FIELD

This invention relates generally to the field of ergonomic handles for putty knives and scrapers incorporating a feature that enhances the insertion and removal of the handle into and from a user's pocket when temporarily storing the tool between usages.

BACKGROUND

Putty knives and scrapers have had a variety of handle types and shapes made from wood, metal or plastic. Some prior art handles have utilized a relatively soft material such as rubber, or a low durometer plastic, overlaid on a hard core (for strength) in order to provide greater hand comfort and gripability. It is also known in the art to vary the shape of the handle for the same reasons. These types of handles can generally be referred to as ergonomic handles. While this art has eased some of the ergonomic and comfort problems inherent in using a tool for many hours, it has not addressed the consideration of inserting and removing the handle of the tool into and from one's pocket, as many user's, especially tradesmen, prefer to do between usages of the tool.

The prior art ergonomic handles have a soft exterior which tends to grip the interior of the user's pocket when being inserted or removed. This is especially a problem when working on ladders and so forth, since there is a need to store the tool when it is not in use. Difficulty in inserting or removing the tool into or from one's pocket can be inconvenient and time-consuming, at the least, or possibly dangerous if the tool handle does not readily slip into or out of one's pocket. Alternatively, the user might decline to put the tool in his/her pocket or other storage are and climb up or down a ladder or platform, and so forth, while still gripping the tool. Thus both hands would not be available to hold onto the ladder or platform.

The soft exterior and ergonomic designs of the prior art do not adequately address the insertion and removal of the tool into or from the pocket.

Applicant is unaware of any prior putty knife and/or scraper art embodying the combined design goals of user comfort, ergonomics and the ability to readily slide the handle into and out of the user's pocket for temporary storage between usages. For the foregoing reasons, there is a need for a putty knife and scraper as described herein.

SUMMARY

In view of the disadvantages inherent in the previously described art, there is a need for a handle that satisfies the combined challenges of comfort, ergonomics and the ease of insertion and removal from a user's pocket.

A first object of this invention is to provide a handle that is ergonomically superior to the prior art.

A second object is to provide a comfortable handle

A third object of this invention is to provide a handle that can be easily and conveniently inserted and removed from a user's pocket.

Another object of this invention is to provide a handle that is comfortable and efficient to use for extended periods of time.

An additional object of one embodiment of this invention is to provide a handle that can be used to tap nails, boards, and so forth.

A further object of this invention is to provide a handle that can be manufactured in a cost effective manner.

These objects together along with various features of novelty which characterize this invention, are pointed out with particularity in the claims annexed thereto in forming a part of this disclosure. For a better understanding of this invention, its operating advantages and the specific objects obtained by its usages, reference should be made to the accompanying drawings and descriptive matter in which there is illustrated a preferred embodiment.

DETAILED DESCRIPTION OF THE PREFERRED EMBODIMENT

Figure 1:
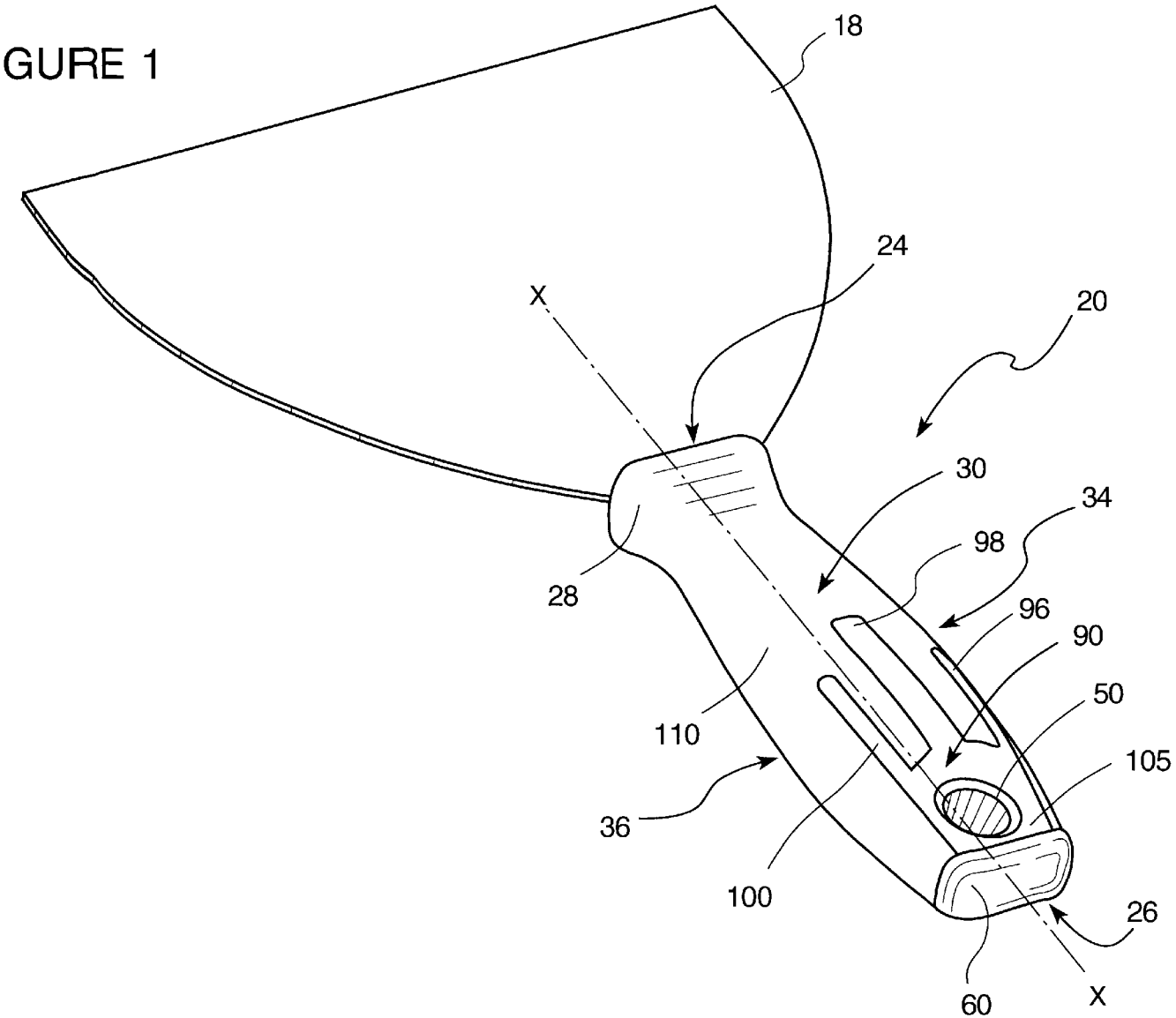
FIG. 1 shows a top rear perspective view of one embodiment of the putty knife and scraper handle with a scraper blade attached.

Referring to the drawings in detail wherein like elements are indicated by like numerals, there is shown in FIG. 1 a handle 20 having a blade end 24 and a tail end 26.

The handle 20 varies in cross section along a longitudinal axis X—X, FIGS. 1,2,4 and 5, from a smaller size at the tail end 26, increasing in size near a midway point between the tail end 26 and the blade end 24 and reducing in size again near the blade end 24 terminating in an increased cross sectional area thumb rest 28, best seen in FIGS. 1,2,4 & 5.

The increase and decrease in the size of the handle 20 along the longitudinal axis X—X is designed to enhance grippability, comfort and efficiency when employing putty knives and scrapers for their intended purposes.

Figure 4:
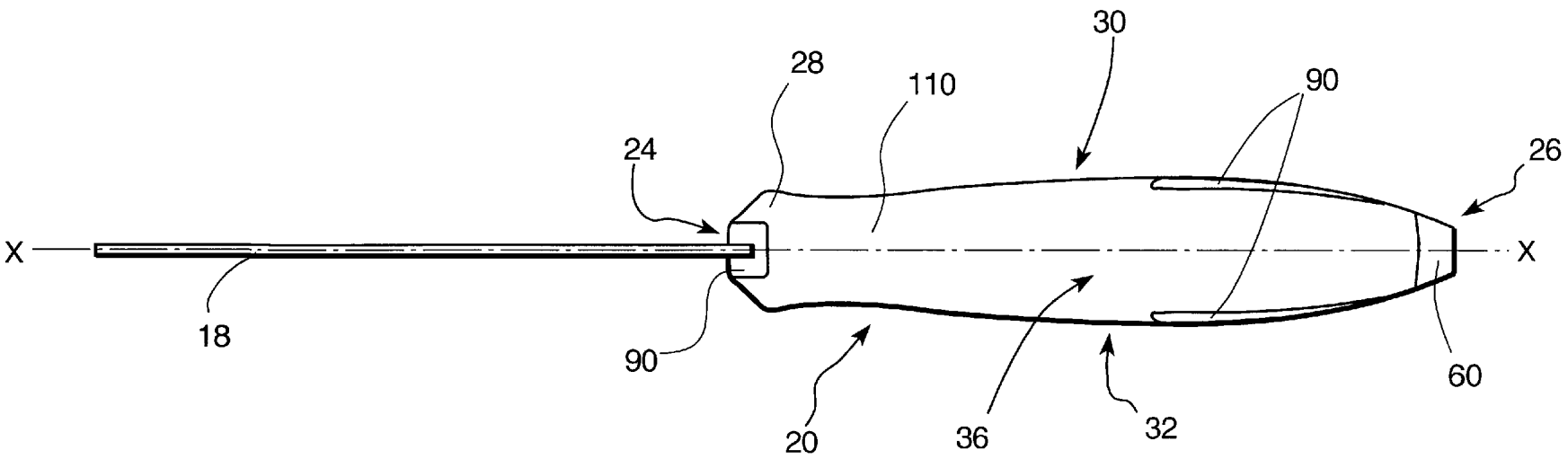
FIG. 4 shows a side view of one embodiment of the putty knife and scraper handle with a scraper blade attached.
Figure 5:
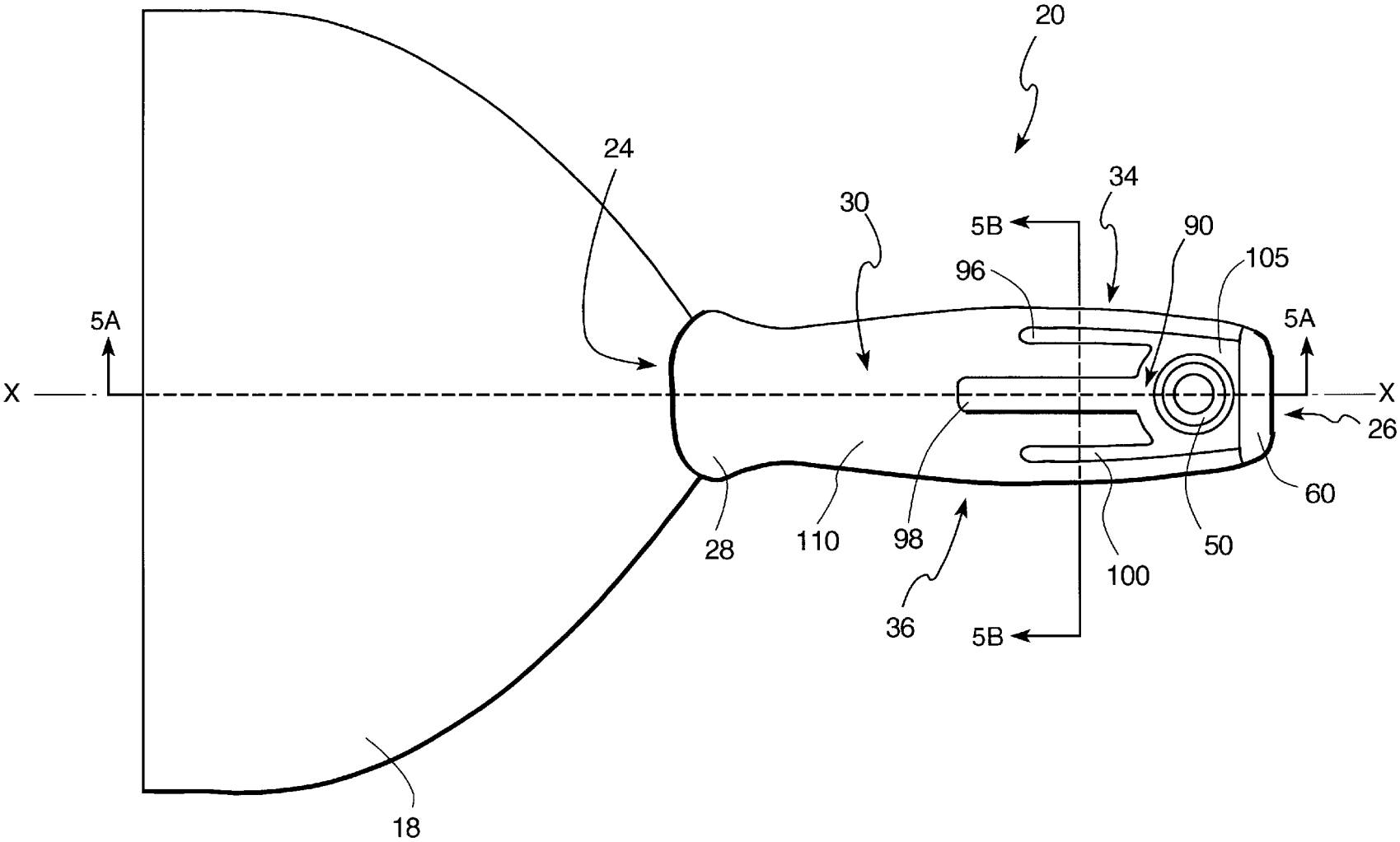
FIG. 5 shows a top view of one embodiment of the putty knife and scraper handle with a scraper blade attached with section lines A—A and B—B.
Figure 6:
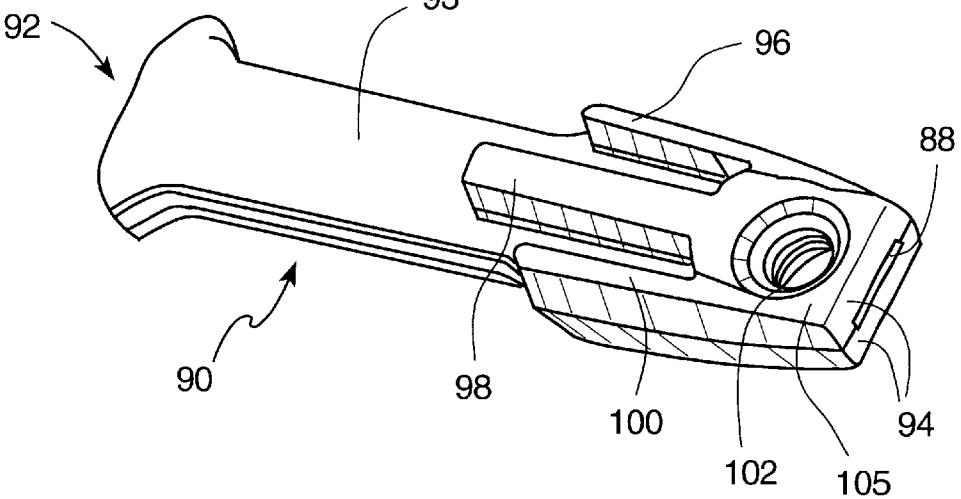
FIG. 6 shows a second end top rear perspective view of one embodiment of the core.
Figure 6A:
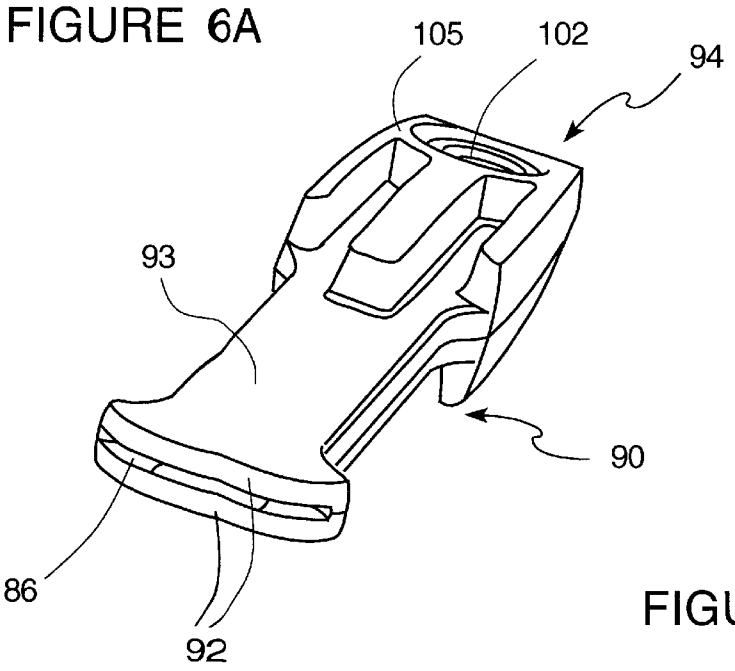
FIG. 6A shows a first end top front perspective view of one embodiment of the core.
Figure 6B:
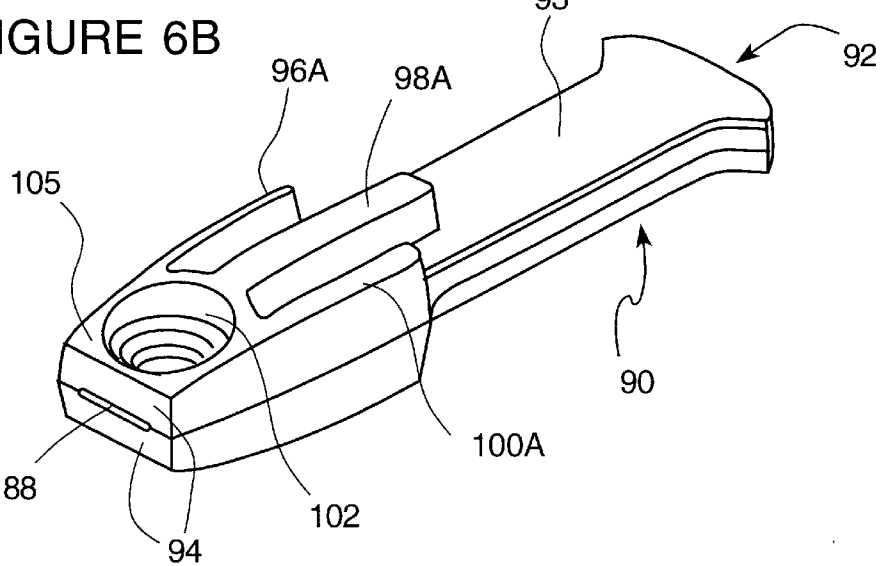
FIG. 6B shows a second end bottom rear perspective view of one embodiment of the core.
Figure 7:
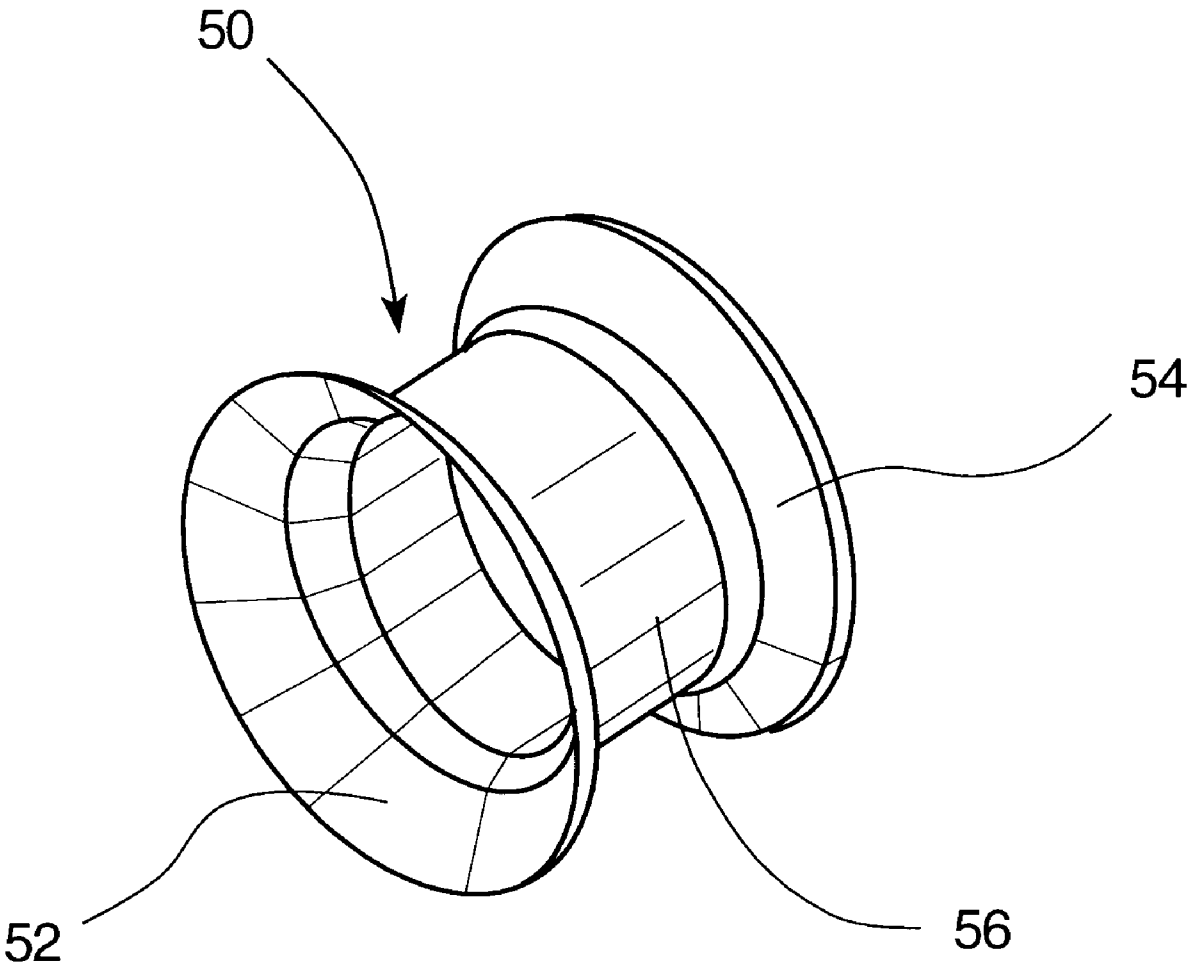
FIG. 7 shows a perspective view of one embodiment of the grommet.
Figure 8A:
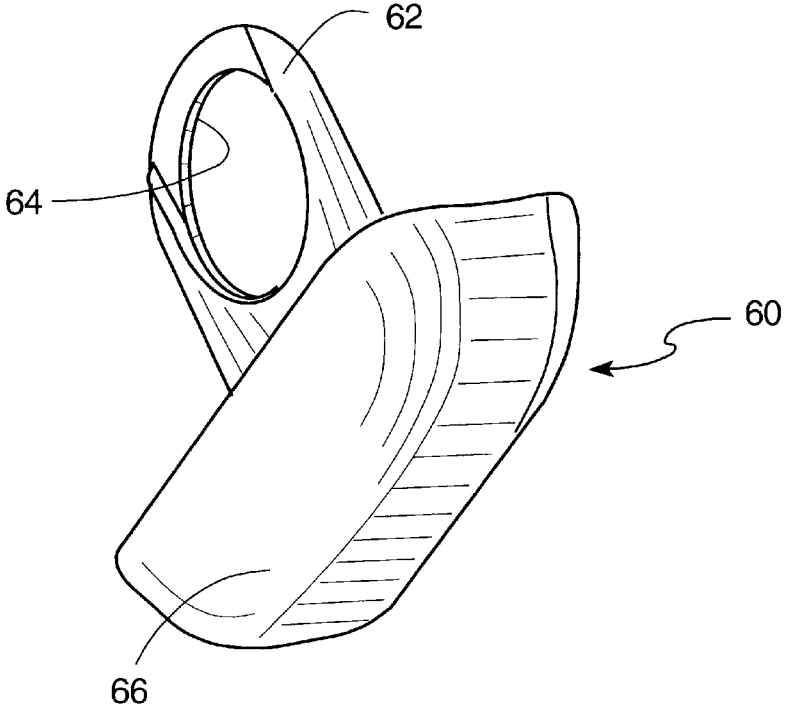
FIG. 8A shows a rear perspective view of one embodiment of the tapping bumper.
Figure 8:
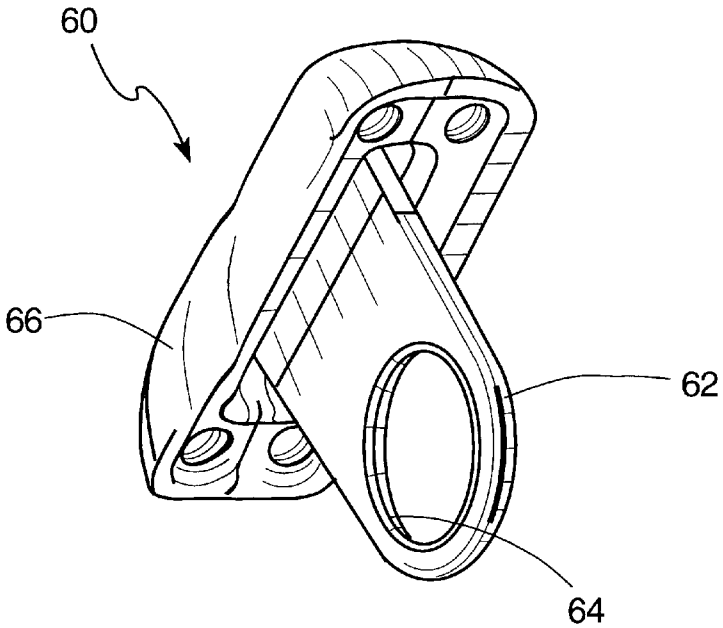
FIG. 8 shows a front perspective view of one embodiment of the tapping bumper.

One embodiment of handle 20 is a four part assembly, having a harder plastic inner core 90, best seen in FIGS. 6, 6A & 6B; a softer plastic overlay 110, as seen in FIGS. 1,2,3,4,5; a grommet 50, FIG. 7; and a bumper 60, FIGS. 8 & 8A. The inner core 90, in a preferred embodiment, is molded from polypropylene but other embodiments could utilize various other plastics or rubbers.

The inner core 90 has a first end 92 with a blade slot 86 for engagement with the blade 18 and a second end 94 incorporating slot 88 for engagement with the bumper 60, FIG. 6, 5A & 6B. The inner core 90 also includes support platform 93 that connects first end 92 to second end 94, and from which protrude the tops and bottoms of raised first, second and third longitudinal ribs 96 & 96A, 98 & 98A and 100 & 100A, respectively, as well as support structure 105 for grommet 50 and bumper 60; the support structure 105 incorporating hang hole 102 to receive grommet 50. The hang hole 102 can be used alone to hang-up the handle 20 in embodiments not utilizing bumper 60 and grommet 50, FIG. 9, 9A.

The longitudinal ribs 96, 96A are arranged such that rib 96 extends from one side of the support platform 93 and rib 96A extends from the other side of support platform 93 in a corresponding mirror position. This embodiment has three ribs 96, 98, & 100 extending from one side of support platform 93 and corresponding ribs 96A, 98A, & 100A extending form the other side of support platform 93 in a mirror image location from ribs 96, 98, & 100, FIGS. 5, 6–6B.

Figure 5A:
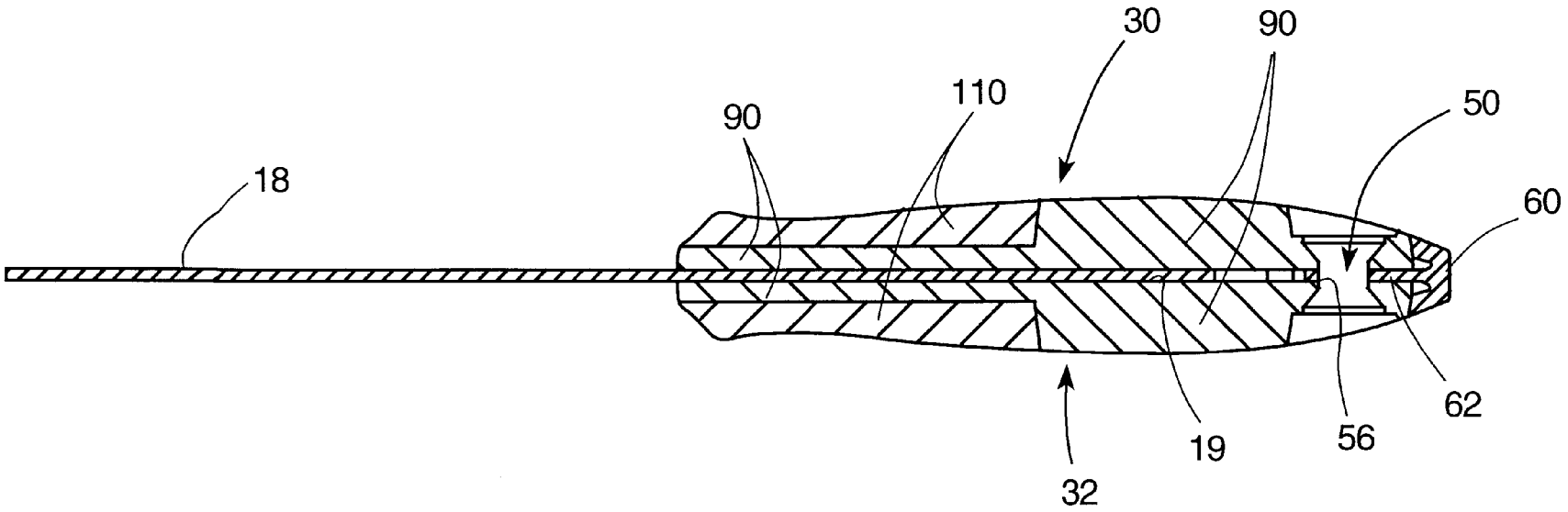
FIG. 5A shows a sectional view along 5A—5A in FIG. 5 of one embodiment of the putty knife and scraper handle with scraper blade attached.

The exposed portions of the top and bottom longitudinal ribs 96 & 96A, 98 & 98A and 100 & 100A, as well as the top and bottom surfaces of the support structure 105, form a portion of handle 20 top and bottom surfaces 30 and 32, respectively. The exposed portions of overlay 110 constitute the remaining, larger portion of the top and bottom surfaces 30 and 32, as well as the entirety of right and left sides 34, 36 of the handle 20, as best seen in FIGS. 5, 5A and 5B.

The inner core 90 is encased by the overlay 110 except for the longitudinal ribs 96, 96A, 98, 98A, 100 & 100A, the support structure 105, second end 94 and first end 92, specifically an area circumscribing the blade slot 86, FIGS. 1,2,6,6A & 6B.

Figure 5B:
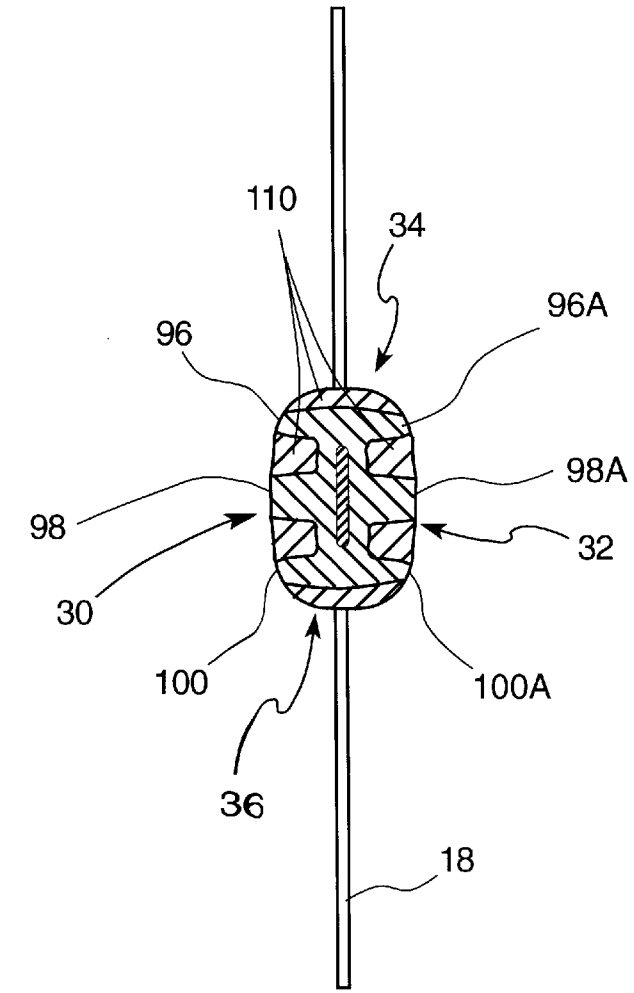
FIG. 5B shows a sectional view along 5B—5B in FIG. 5 of one embodiment of the putty knife and scraper handle with a scraper blade attached.

The longitudinal ribs 96 & 96A, 98 & 98A and 100 & 100A, preferably rise slightly above the adjoining surfaces of the overlay 110 by approximately a range of 0.010–0.030 inches and preferably 0.020 inches, best seen in FIG. 5B. Thus establishing predominant contact with the inner surfaces of the user's pocket (not shown) whenever the user inserts the handle 20 into his or her pocket for the temporary storage of a tool incorporating handle 20. The greater friction resulting from contact with the softer overlay 110 is, therefore, mitigated, reducing the "drag" that would have otherwise occurred if overlay 110 were flush with the exposed ribs 96 & 96A, 98 & 98A and 100 & 100A of the harder, more slippery inner core 90. The inner core 90 configuration and material properties result in a much easier and safer pocket insertion and removal of the preferred embodiment of the handle 20 than a handle 20 covered entirely with the softer overlay 110 (not shown).

FIG. 5B shows a cross sectional view of the longitudinal ribs 96, 96A, 98, 98A, 100, 100A and the overlay 110 in between. The overlay 110 forms a concave surface between the ribs where the edges of the overlay 110 are at the same height as the ribs 96, 96A, 98, 98A, 100, 100A. This provides a smooth contact surface, or no sharp edges, for a user's hand in gripping the handle 20.

Figure 2:
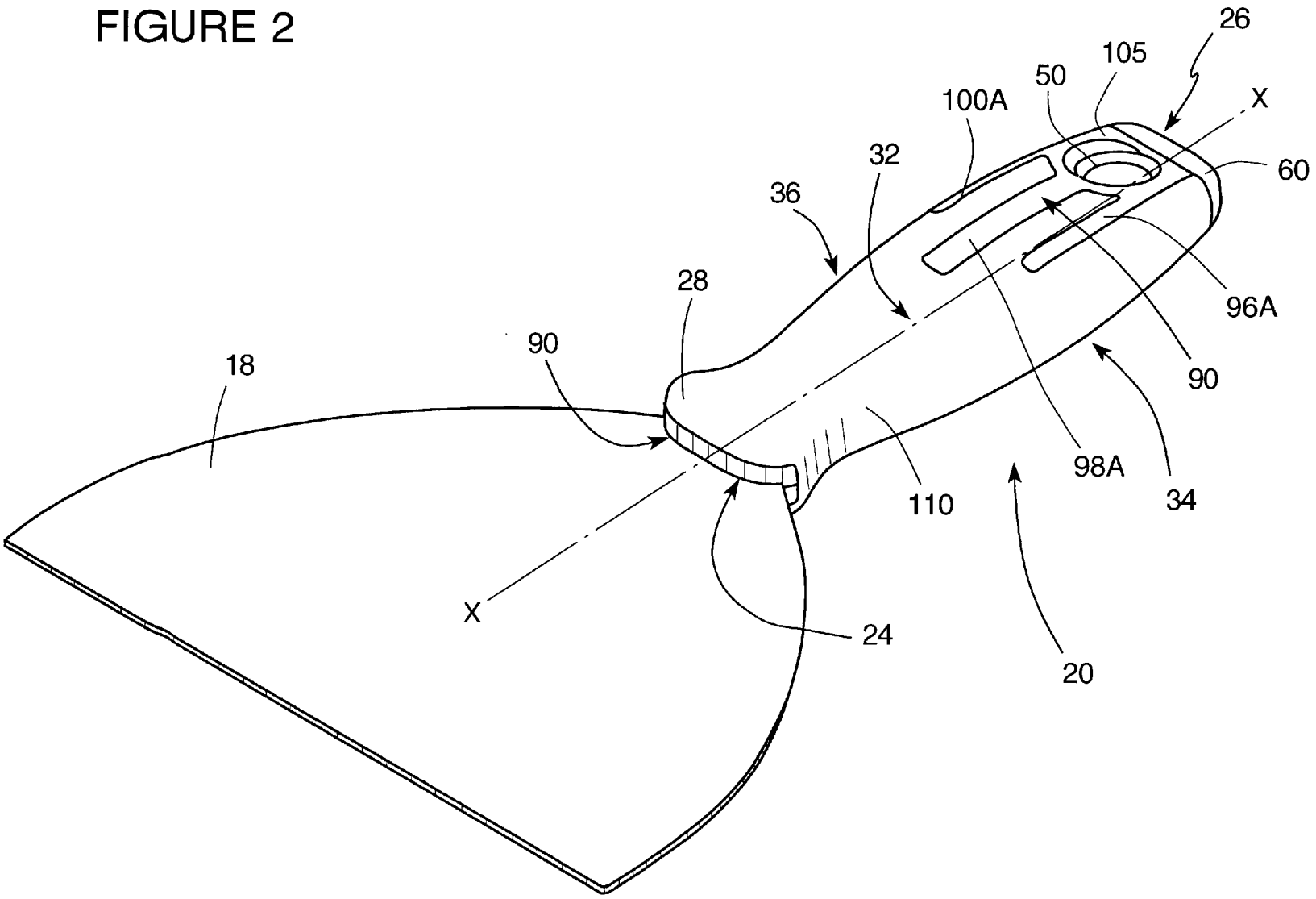
FIG. 2 shows a bottom front perspective view of one embodiment of the putty knife and scraper handle with a scraper blade attached.
Figure 3:
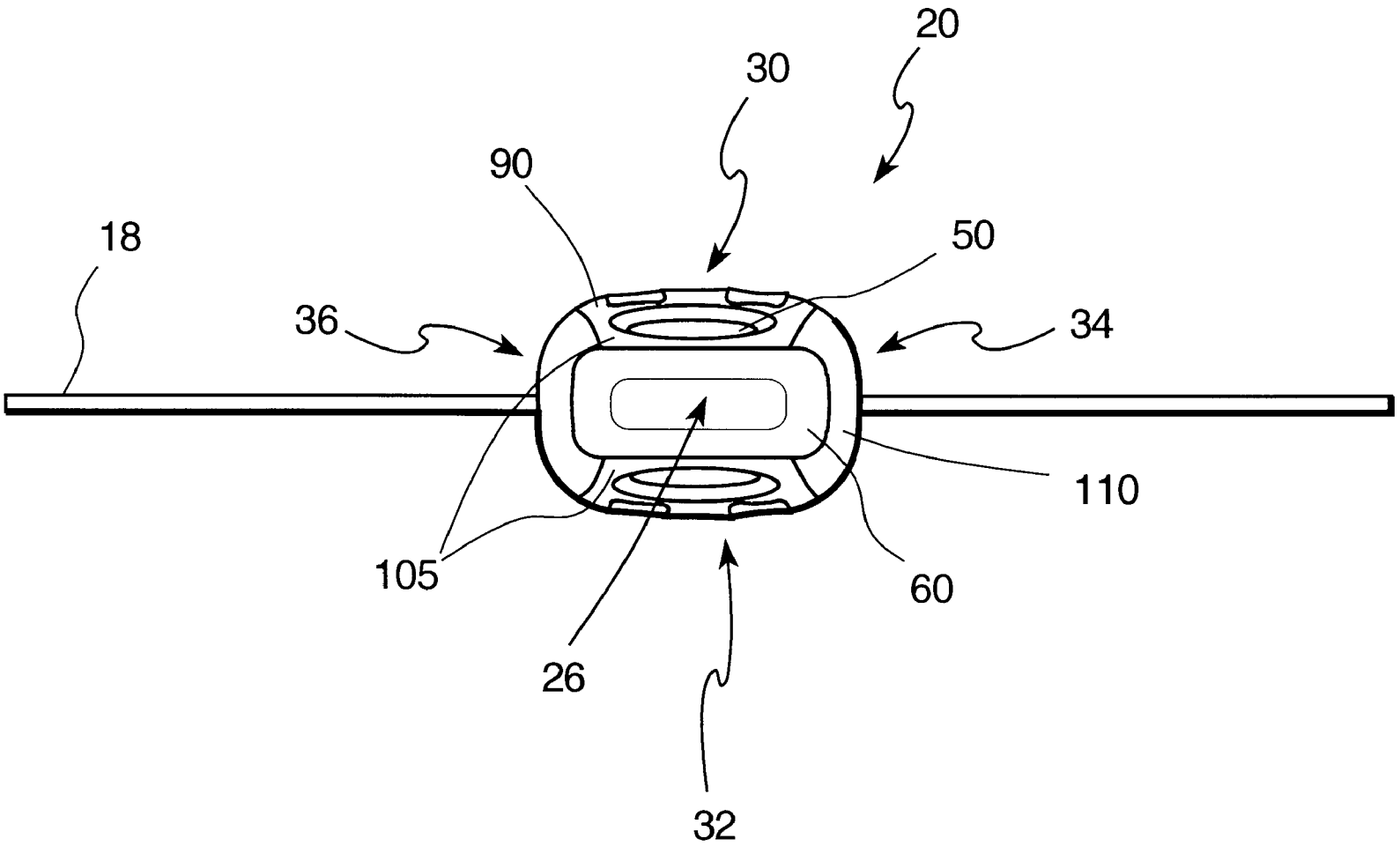
FIG. 3 shows a tail end view of one embodiment of the putty knife and scraper handle with a scraper blade attached.

The three exposed longitudinal ribs 96 & 96A, 98 & 98A and 100 & 100A of inner core 90 originate from support structure 105 and extend toward blade end 24; being arranged in approximate parallel alignment on both top and bottom surfaces 30 and 32, respectively. First ribs 96 & 96A and third ribs 100 & 100A are positioned near right and left sides 34, 36, respectively; with ribs 98 & 98A centrally located in between, as seen in FIGS. 1,2,5.

The longitudinal ribs could number between one and five on both top and bottom surfaces 30 and 32, respectively; three ribs 96, 96A, 98, 98A, 100, 100A, as shown in the preferred embodiment, being the optimal. Furthermore, various rib lengths and widths are feasible, but in a preferred embodiment the length, in aggregate, should extend between one-quarter and one-half the length of handle 20, while the width spanning, in aggregate, between one-quarter and three-quarters of the width of handle 20.

Figure 10:
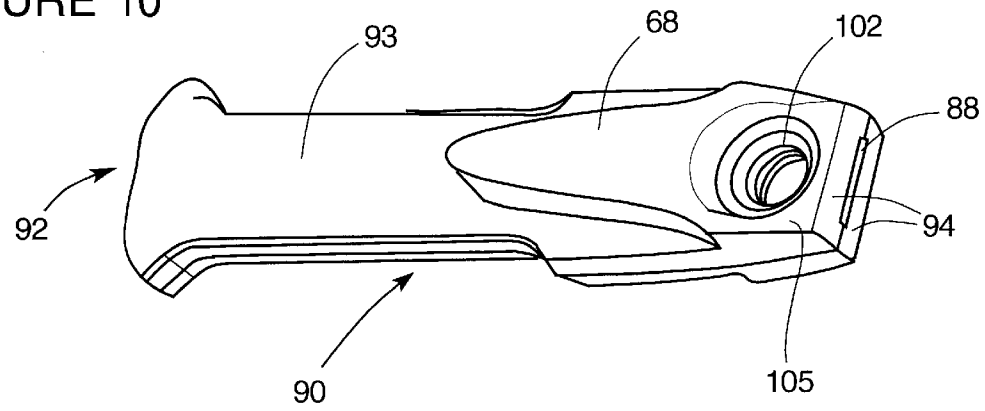
FIG. 10 shows a side perspective view of another embodiment of the inner core showing one embodiment of an upright.
Figure 11:
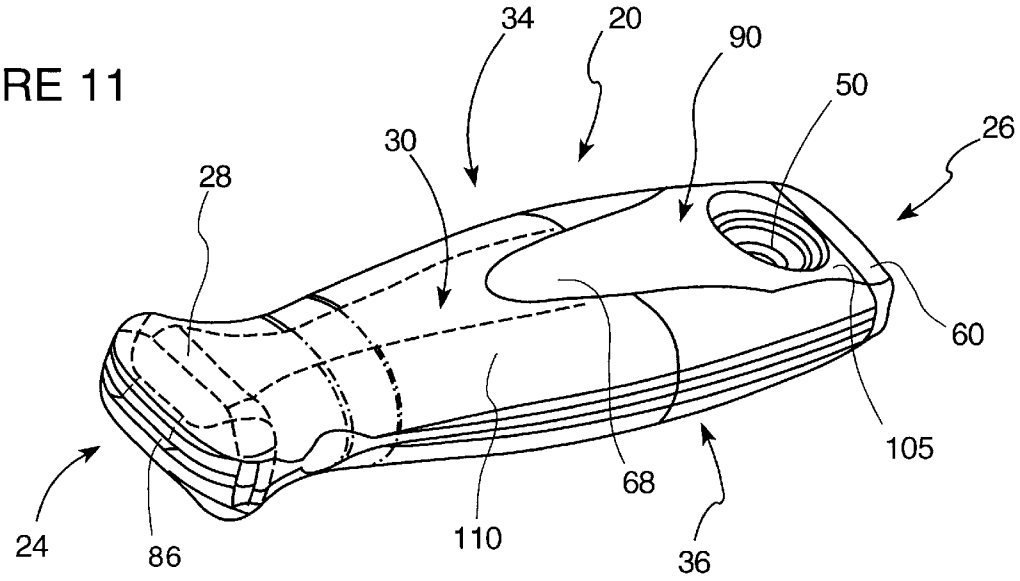
FIG. 11 shows a blade end perspective view of the handle with the upright exposed on the top surface.

While the preferred embodiment discloses a range for the width in aggregate between one-quarter and three quarters, widths outside of this range may also be acceptable. Where one preferred embodiment discloses at least one rib on the top 30 and bottom 32 surfaces of the handle 20, other configurations of exposed core 90 could be utilized such as oblong, uprights, oval, teardrop, circular and other exposed symmetric and irregular areas. These examples are meant to be descriptive and not limiting. The upright 68 could be in any of the configurations as expressed above so long as a portion of the upright 68 was exposed on the top and bottom surfaces 30, 32 of the handle 20, FIGS. 10 & 11.

The areas of exposed core 90 would be longitudinally oriented and extend from near the second end 94 towards the first end 92 creating a portion of the handle 20 top surface 30 and bottom surface 32 in approximately the area of the tail end 26 half of the handle 20. A feasible area of coverage of the top surface 30 and bottom surface 32 by the upright 68 would be between approximately 25–90% of the surface area. This could easily be accomplished by modifying the tooling used to manufacture inner core 90.

The inner core 90 is injection molded from polypropylene having a range of approximately 75–105 Shore A Durometer hardness and preferably approximately 90 Shore A Durometer hardness.

The second part of the handle 20 is the overlay 110, which is injection molded over and affixed to the inner core 90 without the need for adhesives or mechanical fasteners. The overlay 110 is a styrenic thermoplastic with a range of approximately 45–75 Shore A Durometer hardness and preferably approximately 60 shore A Durometer hardness, the overlay 110 covering most of the inner core 90 except the specific areas previously noted. Other embodiments of the overlay 110 could utilize a wide range of plastics or rubbers.

This embodiment of the handle 20 is also comfortable to hold in a user's hand. The fingers and thumb of a user's hand (not shown) grip predominantly the softer overlay 110 material which is compressible, enhancing grippability while minimizing fatigue in extended use. The varying contour of handle 20 along longitudinal axis X-X also contributes to the comfort, safety and efficiency of the user when employing a tool incorporating handle 20.

The preferred embodiment of handle 20 includes a cylindrical metal grommet 50, FIG. 8. The grommet 50 consists of first flare 52, cylindrical portion 56 and second flare 54.

The grommet 50, which may be plated, extends from near the top surface 30, FIG. 1,3,4 & 5A, of handle 20 to near the bottom surface 32, FIGS. 2,3,4 & 5A, on the opposite side. Grommet 50 can be used to hang the handle 20 from, for instance, a nail or rod, (not shown). Non-metal materials such as polymers may also be used for grommet 50.

The preferred embodiment of this invention also incorporates a metal bumper 60, FIGS. 8 & 8A, at the tail end 26, FIG. 4. The bumper 60 includes a tapping head 66, tang 62 and tang hole 64, FIGS. 8 & 8A. Tang 62 is inserted in slot 88 at second end 94 of inner core 90, the tang 62 is retained by cylindrical portion 56 of grommet 50 which is installed in said tang hole 64 upon assembly, FIG. 5A. The bumper 60 can be used for tapping-down protruding nail heads (not shown) that may be encountered on the working surface while utilizing a tool having the handle 20, or the bumper 60 may be employed for other tapping functions. The bumper 60 in a preferred embodiment is made from cast zinc and plated. It is tapered so as not to inhibit the insertion and removal of the handle from the user's pocket. Other non-metal materials such as polymers could be used for the bumper 60.

This embodiment of the handle 20 shows an attachment to a scraping blade 18, FIGS. 1 & 2. It is to be understood that this in no way limits the use of this handle to blades configured like blade 18. This handle 20 can also be used on a wide variety of putty knife blades and various other sizes of scraping blades similar in function to the one shown.

The manufacture and assembly of handle 20 is achieved by first injection molding the polypropylene inner core 90. Inner core 90 is then placed into another mold where the styrenic thermoplastic overlay 110 is injection molded over it.

Next, bumper 60 and grommet 50 are assembled. Tang 62 on bumper 60 is inserted into slot 88 of inner core 90. The grommet 50, which has one end previously flared, is inserted in hang hole 102 in inner core 90, passing also through tang hole 64 in tang 62. The other, previously cylindrical end of grommet 50 is then flared by a typical flaring process. This retains both grommet 50 and bumper 60 in inner core 90, and thus, also in handle 20.

The tang 19 of blade 18 is next heated and inserted under pressure into blade slot 86 of the inner core 90, the blade slot 86 forms a "press-fit" with the tang 19 of blade 18. This completes the full assembly of handle 20 and blade 18.

Figure 9:
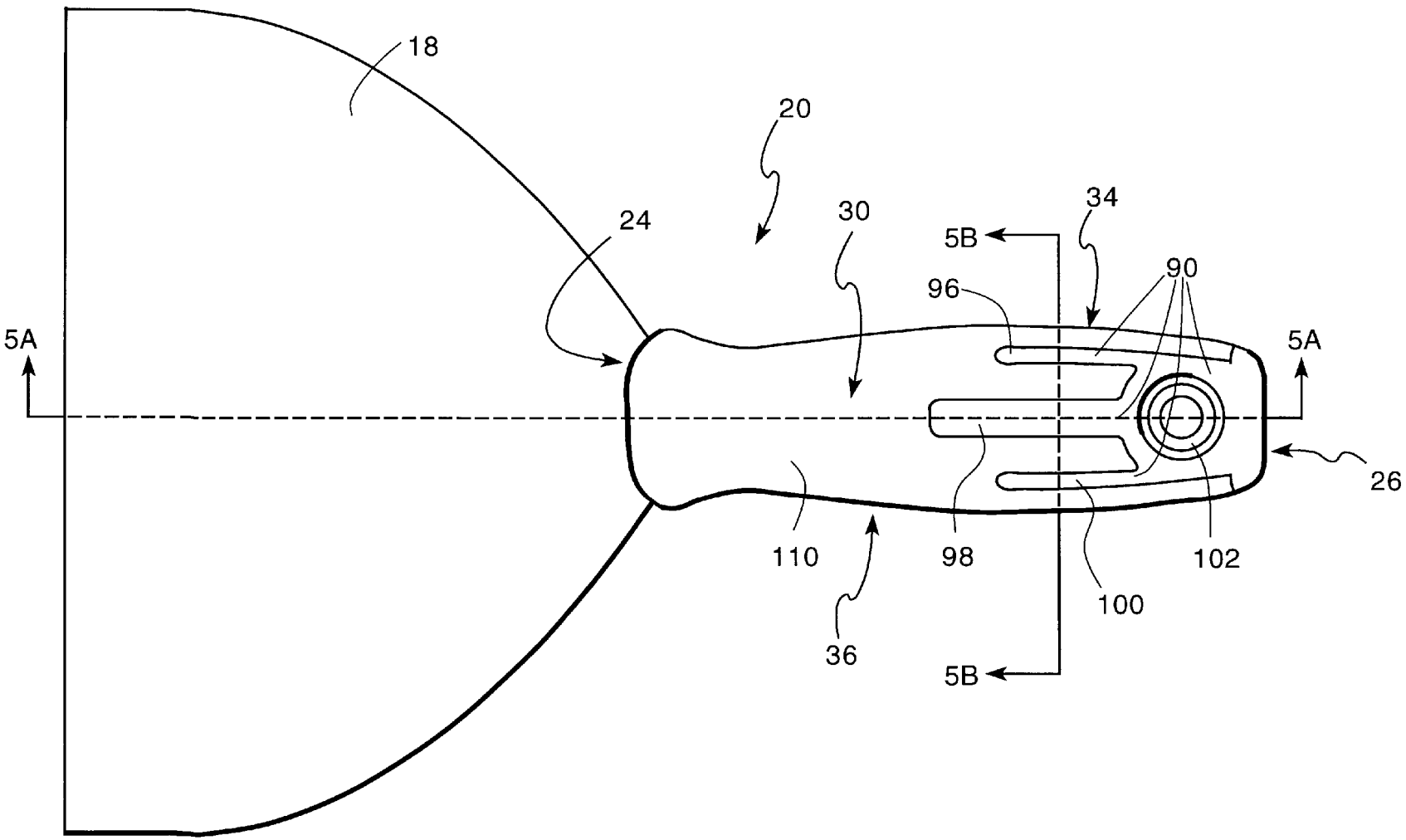
FIG. 9 shows a top view of an alternative embodiment of the putty knife and scraper handle not having the bumper or tapping end as a separate component.
Figure 9A:
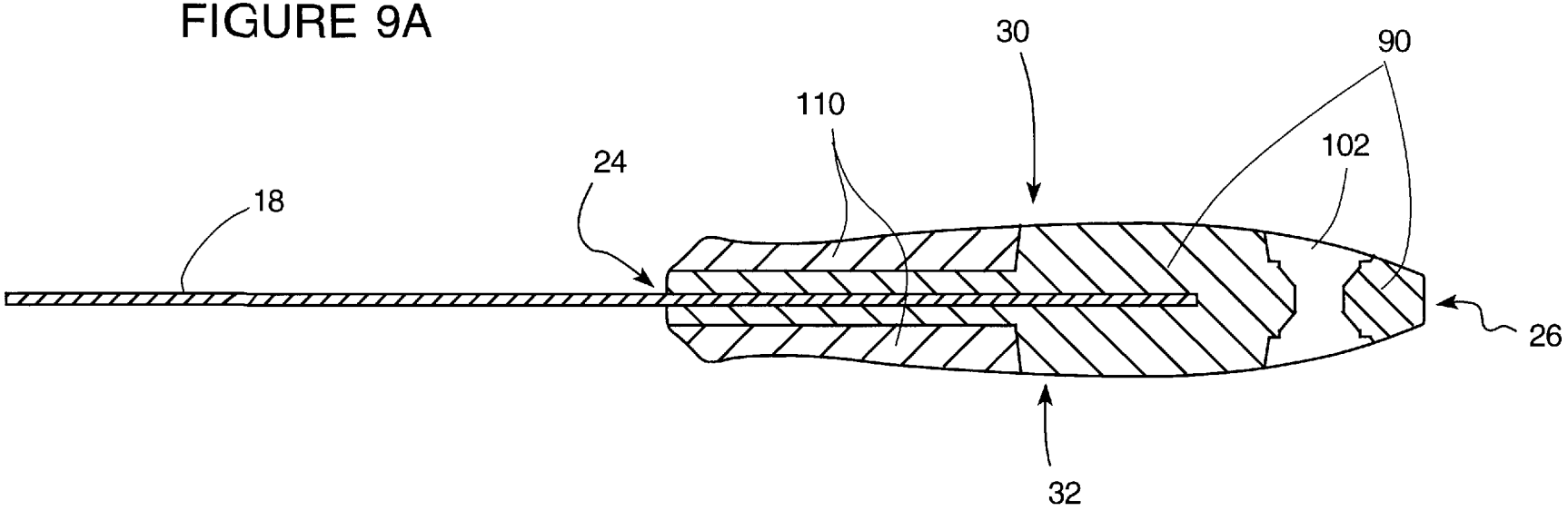
FIG. 9A shows cross section 5A—5A from FIG. 9.
Figure 9B:
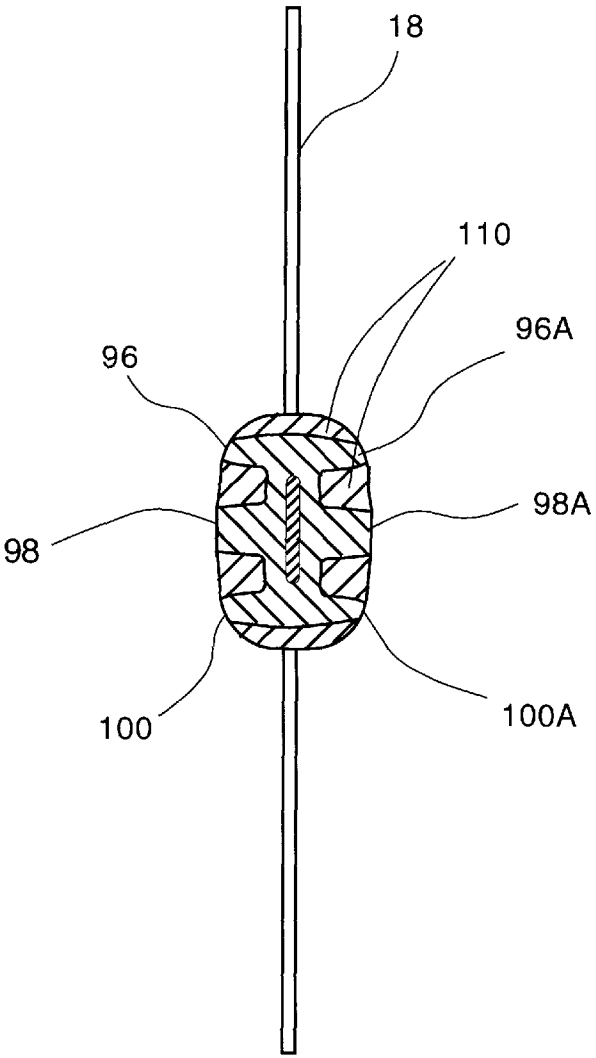
FIG. 9B shows cross section 5B—5B from FIG. 9.

While the preferred embodiment of this invention incorporates both a grommet 50 and a bumper 60, alternative embodiments could be manufactured with just a grommet 50, just a bumper 60 or neither of these components. Alternative embodiments of handle 20 without grommet 50 and/or bumper 60 would necessitate a mold for inner core 90 with modified design that would replace the space previously occupied by these components with the material of inner core 90. An embodiment of handle 20, with the bumper 60 omitted, is shown in FIGS. 9, 9A & 9B. In this embodiment, the inner core 90 has been extended to occupy the space previously occupied by bumper 60. This embodiment would be less suitable for tapping down nails, but would cost less to manufacture, thus offering the trade a lower cost alternative.

It will now be apparent to those skilled in the art that other embodiments, improvements, details and uses can be made consistent with the letter and spirit of the foregoing disclosure and within the scope of this patent, which is limited only by the following claims, construed in accordance with patent law, including the doctrine of equivalents.

We claim:

1. A putty knife and scraper handle comprising:

a molded inner core for strength and stiffness having higher hardness than a surrounding overlay, the inner core having a first end and a second end interconnected by a support platform, a blade slot in the first end for engagement with a blade tang, at least one longitudinal rib protruding from opposite sides of the support platform and exposed on a top surface and a bottom surface of the handle, the ribs extending from near the second end towards the first end, where the ribs facilitate the insertion and withdrawal of the handle into and from a users pocket; and the overlay having lesser hardness than the inner core and molded over a portion of the inner core for primary engagement with a user's hand for the purpose of user comfort, safety and efficiency while using a tool employing the handle, the overlay completing the top and bottom surfaces of the handle, the handle having a blade end and a tail end.

2. The putty knife and scraper handle of claim 1, in which:

the overlay located between multiple ribs on the top and bottom surfaces is concave, having a maximum depth ranging between 0.010 and 0.030 inches, further facilitating the insertion and removal of the handle into and from a user's pocket.

3. The putty knife and scraper handle of claim 1, in which:

the inner core has a hardness in the range of approximately 80–105 Shore A Durometer.

4. The putty knife and scraper handle of claim 1, in which:

the overlay has a hardness in the range of approximately 45–70 Shore A Durometer.

5. The putty knife and scraper handle of claim 1, further comprising:

the inner core near its second end having a hang hole extending from the top surface to the bottom surface for hanging-up a tool incorporating the handle.

6. The putty knife and scraper handle of claim 5, further comprising:

the inner core exposed at the tail end and having a tang slot for receiving a tang of a bumper;

the bumper having the tang containing a tang hole, the tang inserted into the tang slot; and a grommet for insertion through both the hang hole and the tang hole for attaching the bumper to the inner core.

7. The putty knife and scraper handle of claim 1, in which:

the longitudinal ribs are exposed on the top and bottom surfaces over an accumulative area that spans approximately 25%–75% of the width of the handle and approximately 25%–50% of the length of the handle.

8. A putty knife and scraper handle comprising:

a molded inner core for strength and stiffness having higher hardness than a surrounding overlay, the inner core having a first end and a second end interconnected by a support platform, a blade slot in the first end and a hang hole passing through the inner core near the second end, at least one longitudinal rib protruding from opposite sides of the support platform and exposed on a top surface and a bottom surface of the handle, the ribs extending from near the second end towards the first end, where the ribs facilitate the insertion and withdrawal of the handle into and from a users pocket;

the overlay of lesser hardness than the inner core and molded over a portion of the inner core forming a contiguous handle having the top surface and the bottom surface, a left side and right side, a blade end and a tail end, the overlay engaging the inner core such that the first end and second end are exposed at the blade end and near the tail end, respectively, the overlay for primary engagement with the user's hand.

9. The putty knife and scraper handle of claim 8, further comprising:

the tail end, having a tang slot for receiving a tang of a bumper;

the bumper having the tang containing a tang hole, the tang inserted into the tang slot; and a grommet for insertion through both the hang hole and the tang hole for attaching the bumper to the inner core.

10. The putty knife and scraper handle of claim 8 in which:

the overlay located between multiple ribs on the top and bottom surfaces is concave, having a maximum depth ranging between 0.010 and 0.030 inches, further facilitating the insertion and withdrawal of the handle into and from a user's pocket.

11. The putty knife and scraper handle of claim 8, in which:

the inner core has a hardness in the range of approximately 80–105 Shore A Durometer.

12. The putty knife and scraper handle of claim 8, in which:

the overlay has a hardness in the range of approximately 45–70 Shore A Durometer.

13. The putty knife and scraper handle of claim 8, in which:

the longitudinal ribs are exposed on the top and bottom surfaces over an accumulative area that spans approximately 25%–75% of the width of the handle and approximately 25%–50% of the length of the handle.

14. The putty knife and scraper handle of claim 8, in which:

three longitudinal ribs are exposed on the top surface and three corresponding longitudinal ribs are exposed on the bottom surface.

15. A putty knife and scraper handle comprising:

a molded inner core for strength and stiffness having higher hardness than a surrounding overlay, the inner core having a first end and a second end interconnected by a support platform, a blade slot in the first end for engagement with a blade tang, a longitudinally oriented upright protruding from the support platform and extending from near the second end towards the first end, at least a portion of the upright exposed on a top surface of the handle, a corresponding longitudinal upright protruding from an opposite side of the support platform and extending from near the second end towards the first end and exposed on a bottom surface of the handle, the uprights to facilitate insertion and removal of the handle into and from a user's pocket;

the overlay of lesser hardness than the inner core molded over a portion of the inner core, forming a contiguous handle having the top surface and the bottom surface, a left side and a right side, a blade end and a tail end, the overlay engaging the core such that the blade end has exposed inner core for access to the blade slot, the overlay for primary engagement with a user's hand.

16. The putty knife and scraper handle of claim 15, in which:

the inner core has a hardness in the range of approximately 80–105 Shore A Durometer.

17. The putty knife and scraper handle of claim 15, in which:

the overlay has a hardness in the range of approximately 45–70 Shore A Durometer.

18. The putty knife and scraper handle of claim 15 in which:

the uprights exposed on the tail end half of the handle top and bottom surfaces account for approximately 25–90% of the total area of that half of the top and bottom surfaces.

19. The putty knife and scraper handle of claim 15, further comprising:

the inner core near the second end having a hang hole extending from the top surface to the bottom surface for hanging-up a tool incorporating the handle.

20. The putty knife and scraper handle of claim 15, further comprising:

the inner core exposed at the tail end, having a tang slot for receiving a tang of a bumper; and the bumper having the tang containing a tang hole, the tang inserted into the tang slot; and a grommet for insertion through both the hang hole and the tang hole for attaching the bumper to the inner core.

* * * * *